United States Patent [19]

Tominoi

[11] 4,171,566

[45] Oct. 23, 1979

[54] WIRE FEED AND CONTACT INSERTION APPARATUS

[75] Inventor: Kunitada Tominoi, Kawasaki, Japan

[73] Assignee: AMP Incorporated, Harrisburg, Pa.

[21] Appl. No.: 871,666

[22] Filed: Jan. 23, 1978

[30] Foreign Application Priority Data

Jan. 25, 1977 [GB] United Kingdom ..... 2866/77

[51] Int. Cl.[2] ..... H01R 43/00

[52] U.S. Cl. ..... 29/748; 29/564.4; 29/564.6; 29/742; 29/747

[58] Field of Search ..... 29/747, 748, 752, 754, 29/742, 759, 564.4, 564.6, 629

[56] References Cited

U.S. PATENT DOCUMENTS 2,657,454 11/1953 Huyett ..... 29/754 X 3,955,414 5/1976 Anderson ..... 29/747

4,087,907 5/1978 Taylor ..... 29/754 X

*Primary Examiner*—Carl E. Hall

*Attorney, Agent, or Firm*—Allan B. Osborne

[57] ABSTRACT

A wire stuffer mechanism removes wires successively from a jig at a first operating station (e.g. terminating) and then transfers them to a second station (e.g. contact inserting) spaced from the first station. The jig is annular and has closely spaced wire locating slots on one side. The transfer mechanism includes a plurality of widely circumferentially spaced jaws mounted for stepped rotation between the stations in synchronism with incremental movement of the jig. The contact insertion mechanism comprises contact guides of complementary shape to the contact and insertable into a housing cavity from one side of the housing to mate with and guide a contact into the cavity from the other side of the housing.

4 Claims, 19 Drawing Figures

WIRE FEED AND CONTACT INSERTION APPARATUS

The invention relates to apparatus for inserting an electrical contact into a through-cavity of a connector housing. The invention also relates to apparatus for feeding individual wires of a series of wires successively to spaced apart operating stations, for example, to a terminating station where the wires are stripped and terminated by electrical contacts and then to an insertion station where the terminated wires are inserted into respective cavities of a connector housing.

According to one aspect of the invention, apparatus for inserting a contact terminating a wire into a housing throughcavity comprises means to locate the contact generally in alignment with the cavity and adjacent a rear face of the housing; a reciprocable contact guide of complementary shape to the contact mounted in alignment with the cavity adjacent a front face of the housing; and, means to insert the contact guide through the cavity from the front face into mating engagement with the contact and to insert the contact guided by the contact guide from the rear face into the cavity and to withdraw the contact guide from the cavity.

According to another aspect of the invention, apparatus for feeding individual wires of a series of wires successively to spaced apart operating stations comprises a wire locating jig including an annulus or disc having a series of circumferentially closely spaced slots on one side for locating individual wires to extend radially in spaced relation from a wire bundle when located centrally of the jig, the jig being mounted for stepped rotation past a first operating station, a wire transfer mechanism comprising a plurality of widely circumferentially spaced wire gripping jaws mounted for stepped rotation in the same direction as the jig past the first and a second operating station, the jaws being movable axially of the jig from the other side of the jig to grip and remove a wire from a slot and transfer the wire from the first to the second operating station in synchronism with the jig movement.

The invention includes apparatus for terminating wires with electrical contacts at a first operating station and inserting the contacts into respective through-cavities of a connector housing at a second operating station spaced apart from the first operating staion.

An example of wire terminating and contact insertion apparatus incorporating wire feeding apparatus according to the invention will now be described with reference to the accompanying drawings in which.

Figure 1:
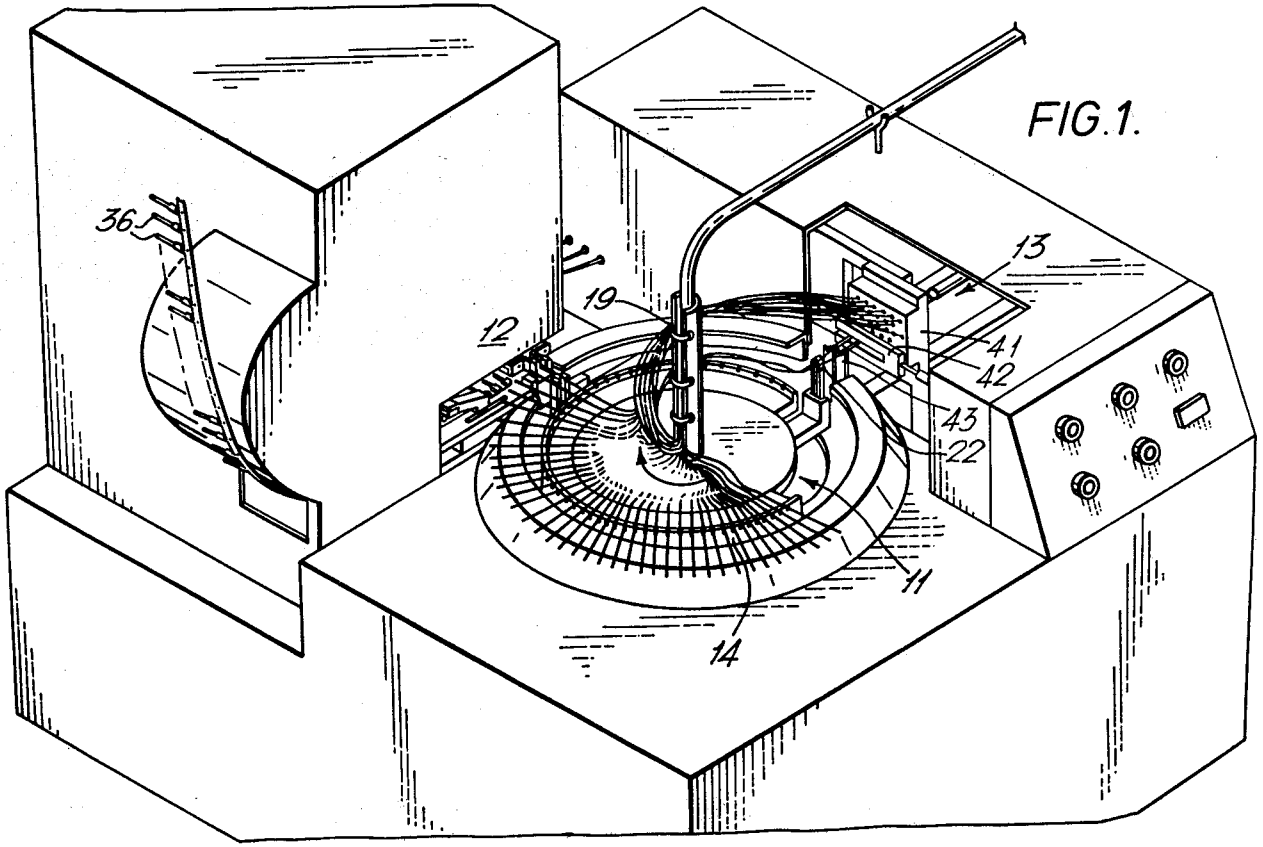
FIG. 1 is a perspective view, partly diagrammatic, of the wire feeding apparatus.
Figure 3:
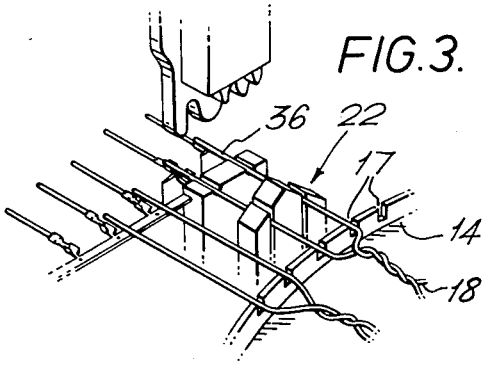
FIG. 3 is a fragmentary view of the wire locating jig and the transfer mechanism at a crimping station.
Figure 2:
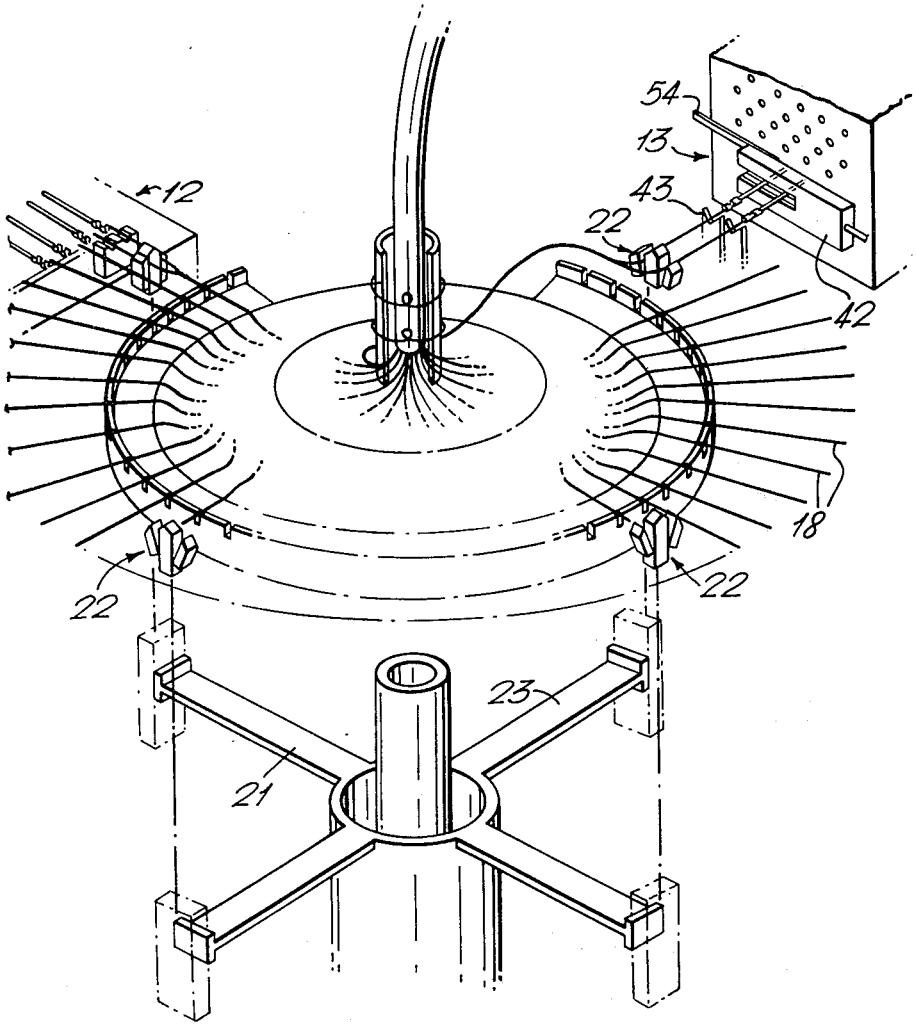
FIG. 2 is an exploded perspective view partly diagrammatic showing a wire locating jig and transfer mechanism.
Figure 4:
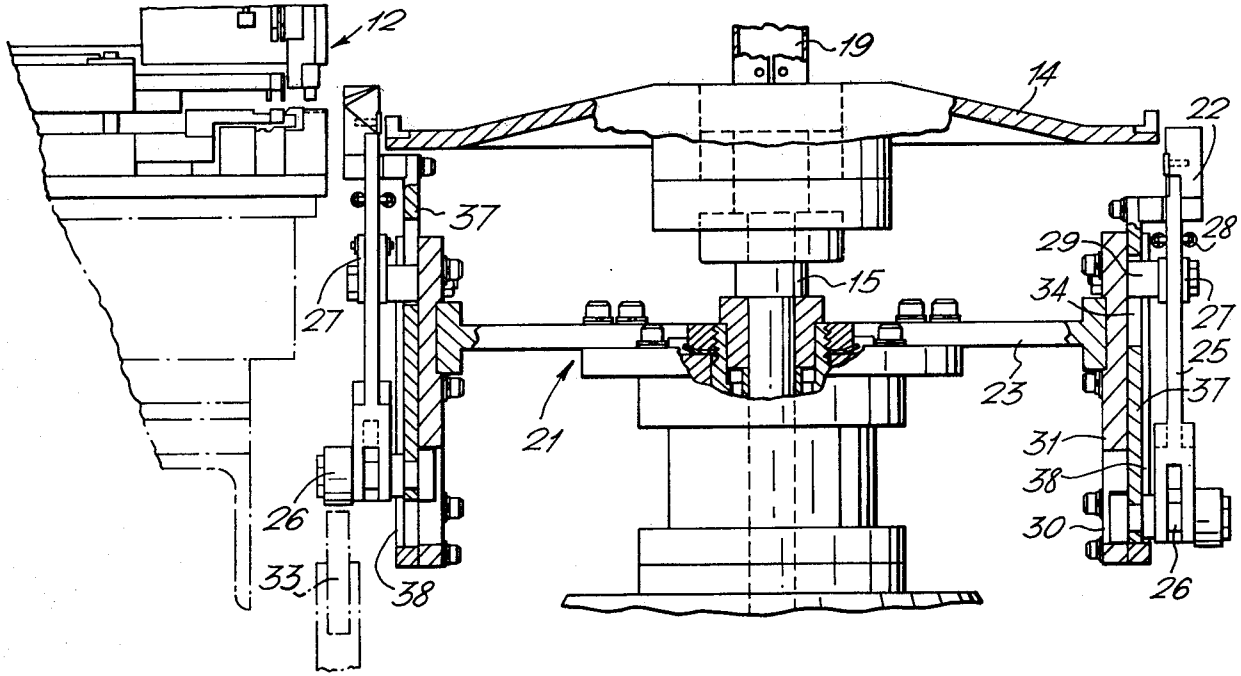
FIG. 4 is an elevational view, partly in cross-section of the wire locating jig and transfer mechanism.
Figure 5A:
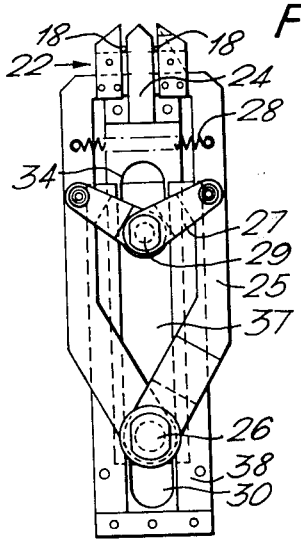
Figure 5B:
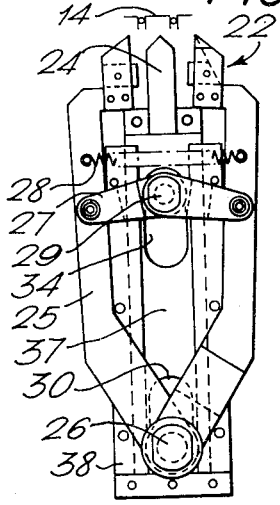
Figure 7:
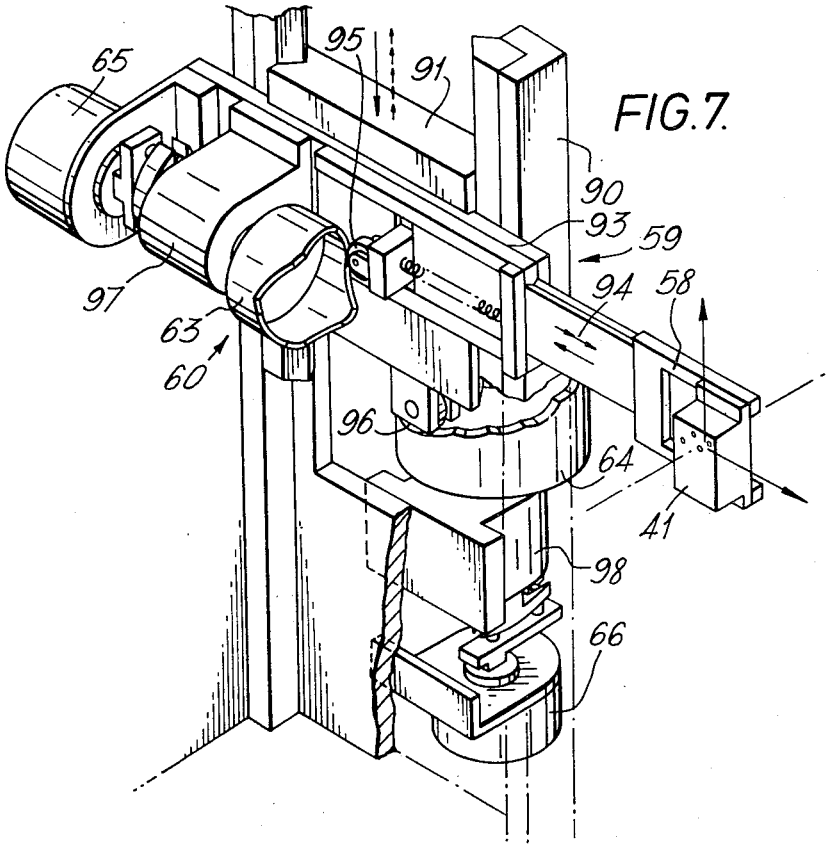
Figure 6:
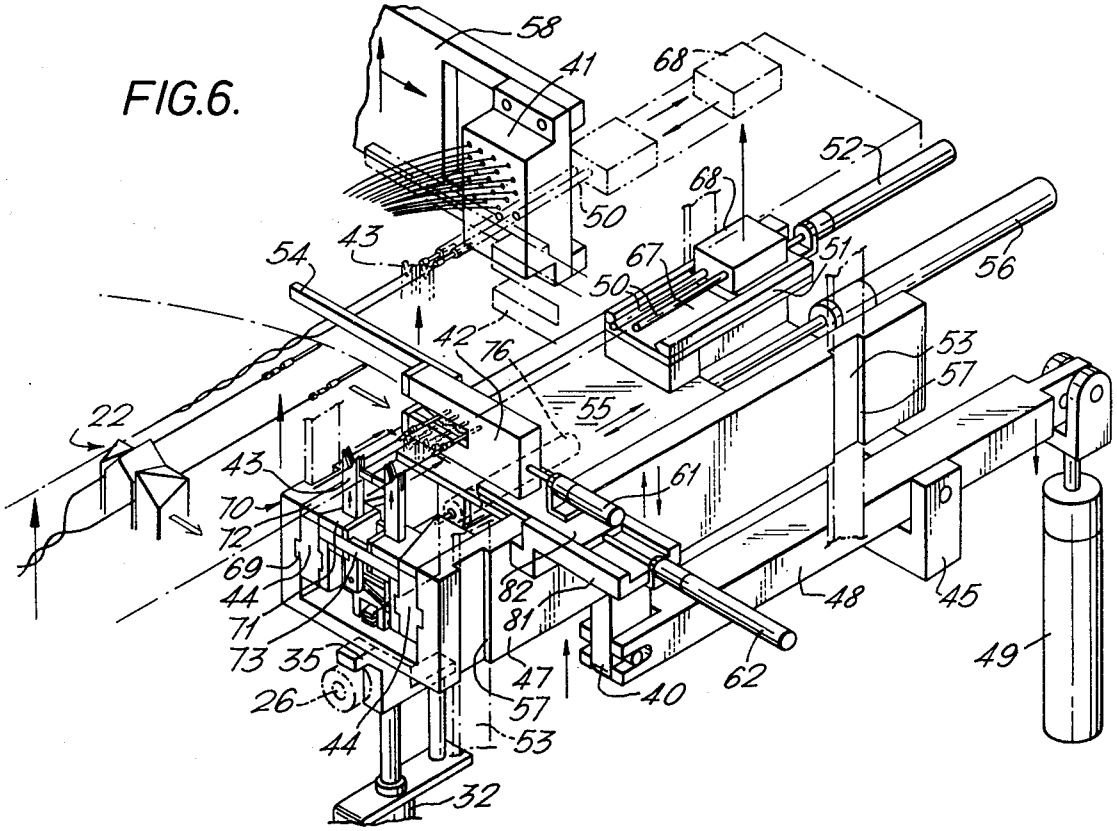
Figure 8A:
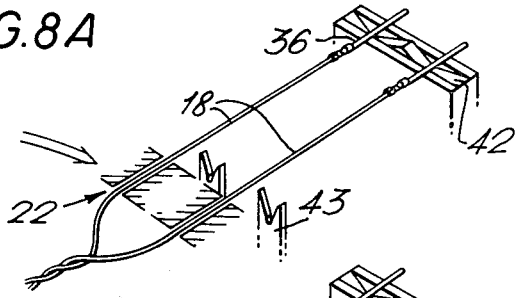
Figure 8B:
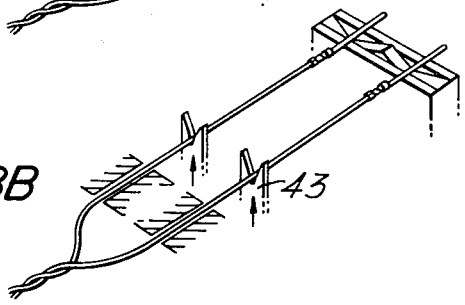
Figure 8C:
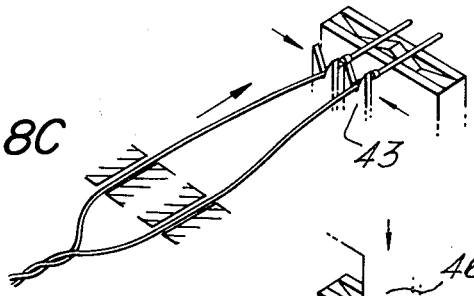
Figure 8D:
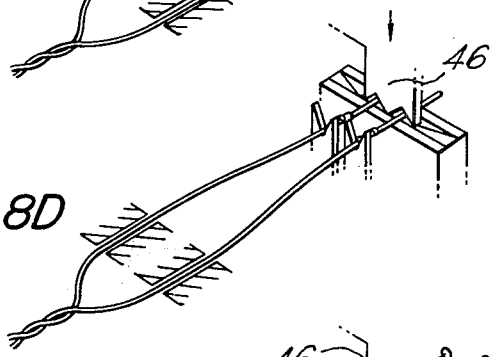
Figure 8E:
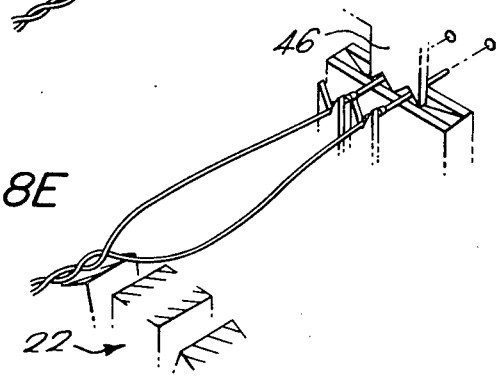
Figure 8F:
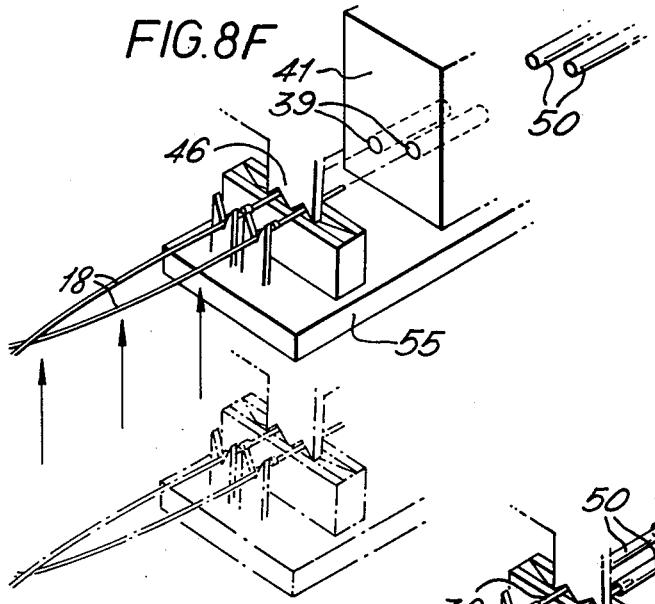
Figure 8G:
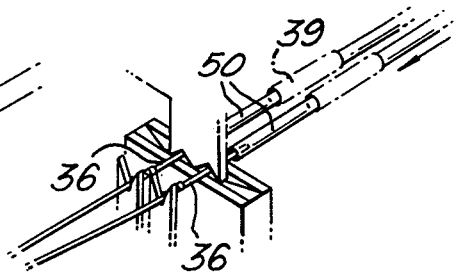
Figure 8H:
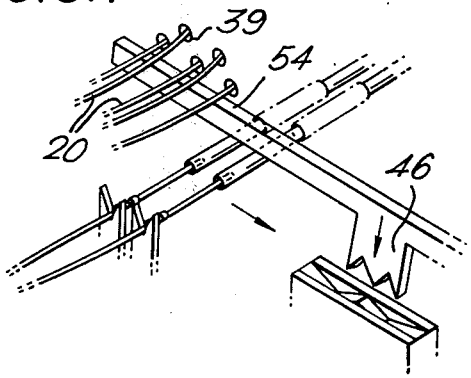
Figure 8I:
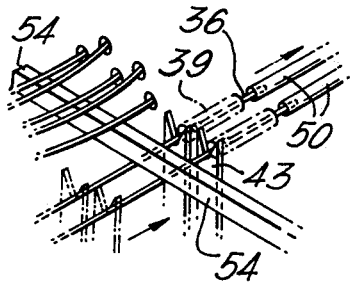
Figure 8J:
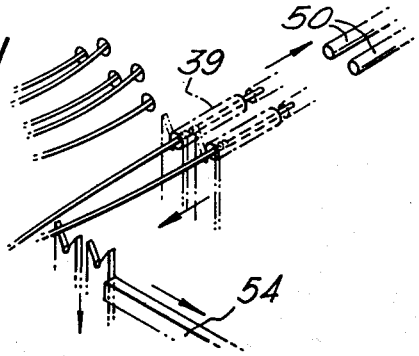
Figure 9:
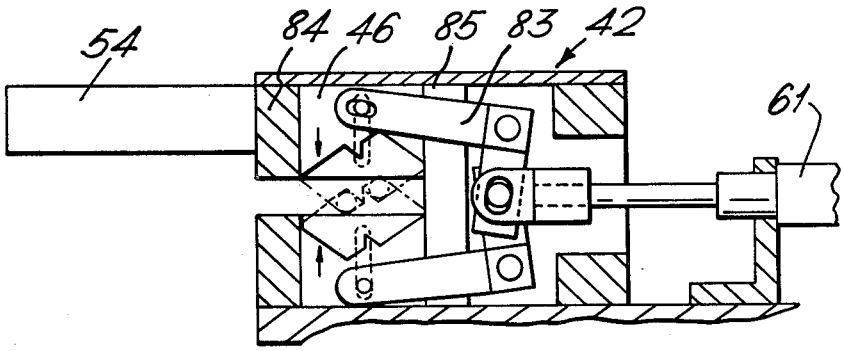

FIG. 5A and B are elevational views, of wire gripping jaws in closed and open conditions, respectively;

FIG. 6 is a perspective view of the contact insertion apparatus;

FIG. 7 is a perspective view partly broken away showing an indexing mechanism for a multi-way housing;

FIGS. 8A–J are diagrams showing successive stages of operation of the contact insertion mechanism; and, FIG. 9 is a cross-sectional view of a pin holder mechanism of the contact insertion apparatus.

As shown in FIGS. 1–4, the wire feeding apparatus 11 includes a wire locating jig 14 and wire transfer mechanism 21 mounted for stepped rotation past a wire stripping and crimping apparatus 12 and contact insertion apparatus 13 disposed at 90° to the stripping and crimping apparatus.

The wire locating jib 14 is releasably mounted, for example, by splines (not shown) on a drive shaft 15 of a stepping motor (not shown). An upper surface of the jig is provided with a series of circumferentially spaced slots for receiving individual wires of wire pairs radiating from a bundle held in a support 19 extending axially of the jig.

The wire transfer mechanism 21 (FIG. 4) comprises four wire-gripping jaws 22 mounted for vertical movement on a carrier plate 31 located at the outer ends of a cruciform frame 23 mounted coaxially with the jig and linked therewith by a gear mechanism (not shown) for rotation through 90° in synchronism with each stepping movement of the jig. The jaws 22 each comprise a pair of limbs 25 pivoted together at a lower end by pin 26 and connected intermediate their ends by a toggle link 27 having pin 29 as its central pivot. Tension springs 28 retain the link in either overcentre position corresponding to open and closed condition of the jaws with vertical displacement of the limbs 25. The upper ends of the limbs 25 are separated by a finger 24 in co-operation with which the jaws can grip a pair of spaced wires 18. The finger 24 is carried by a plate 37 having a vertical slot 34 receiving pin 29, pin 26 being fixed to plate 37 and received in vertical slot 30 in carrier plate 31 permitting vertical displacement of the finger with the limbs. A flange structure 38 is provided on opposite sides of the carrier. The flange structure provides a pocket receiving and guiding plate 37 during vertical movement. The central pin 29 of the toggle is fixed to the carrier plate permitting the vertical displacement of the limbs during shift to either overcentre condition. Fixed cam 33 and finger 35 operated by piston 33 (FIG. 6) are provided at the crimping and insertion stations respectively to close/raise and open/lower the jaws by engagement with the head of pin 26.

The wire stripping and crimping apparatus 12 has dual stripping and crimping heads to strip and crimp two wires and contacts simultaneously but is otherwise of conventional design and will not, therefore, be described further.

In operation of the wire feed apparatus, wires are preloaded into the jig which is then releasably mounted for rotation with shaft 15. Contacts 36 are supplied in strip form to the stripping and crimping apparatus. The jig is stepped to bring individual wire pairs into alignment with the stripping and crimping apparatus. For each incremental stepping movement of the jig the wire-gripping jaws move through 90° successively to engage cam 33 raising and closing about successive wire pairs 18 both to align the individual wires more precisely with the stripping and crimping apparatus and to release them from the jig and transfer the wire pairs to the contact insertion mechanism after crimping. Opening and lowering of the jaws to release the wires after transfer to the insertion mechanism is effected by finger 35.

The contact insertion apparatus (FIG. 6) comprises a channel section frame 47 mounted for vertical movement by trunnions 40 on one end of lever 48 pivoted on fixed cross member 45 and having its other end connected to operating piston 49. Vertical rails 53 are received in a sliding fit in grooves 57 to guide vertical movement of the frame 47 produced by piston 49.

A carriage 55 is mounted for sliding movement along the frame channel by runners 44 located in longitudinally extending grooves 69 in opposite walls of the frame 47 and connected at the carriage rear to operating piston 56. At the carriage rear a slide block 51 is fixed to the upper surface of the carriage and defines a channel 67 slidably receiving a block 68 carrying tubular contact pin guides 50. Operating piston 52 is connected to the block 68 to produce the sliding movement.

At the front of the carriage, the rails carry a contact pusher mechanism comprising a pair of notched contact pushers 43 mounted for vertical sliding movement in plates 71 presenting inclined planes to plates 72 carried by runners 44. The plates 71 are supported for sliding movement together on horizontal guide rails 73 supported by a framework mounted on longitudinal rails slidably mounted on runners 44. A piston 76 is carried by the framework and operatively connected to the contact pushers 43 by an L-shaped lever (not shown) mounted for limited pivotal movement in the framework so that operation of the piston produces initial upward movement of the contact pushers through the limited pivotal movement of the L-shaped link and subsequent horizontal movement of both the contact pushers and support plates 71 rearwardly of the carriage with movement of the contact pushers together as a result of the engagement between the inclined planes. The contact pusher mechanism is linked to the carriage 55 for movement as a unit longitudinally of the frame channel with movement of the carriage by piston 56.

The contact pin holder is mounted on a slider 82 in a channel-section slide block extending transversely of frame 47 at a location between the contact pin pusher 43 and the guides 50. A piston 62 is operatively connected to the slider 82 to move the contact pin holder into and out from the contact pin insertion path. As shown in FIG. 9, the contact pin holder comprises a frame defining spaced vertical guides 84 and 85 between which jaws 46 are located for vertical opening and closing movement. Each jaw is pivotally connected to a longer end of an L-shaped link 83 pivotally connected at its other end to a piston 61 operable to open and close the jaws. A wire engaging arm 54 is fixed to the upper jaw for movement therewith.

A forked housing support 58 carries a multi-way insulating housing 41 above the surface of the carriage 55 at a higher level and between the contact pin pushers 43 and the contact pin guides 50. This ensures clearance for the rotational feeding movement of the wire gripping jaws. The support 58 extends from one end of a slide arm 94 mounted for horizontal sliding movement in a first slide frame 93 mounted in a second slide frame 91 mounted for vertical sliding movement on vertical rails 90 of a fixed frame 59. Indexing of the housing is effected in horizontal and vertical directions by cams 63 and 64 engaging followers 95 and 96 and driven by stepping motors 65 and 66 through gears 97 and 98.

The operation of the contact insertion mechanism is best understoond by referring to FIG. 6 in conjunction with FIGS. 8A–J.

As shown in FIG. 8A wire pairs are fed by jaws 22 so that contact pins are located in pin holders 42. The individual wires then overlie notched contact pushers 43 which are moved upwardly to receive the wires in the notches and towards pin holder 42 converging to position the pins more closely together as a result of sliding engagement of inclined planes. Contact gripping jaws 46 of the pin holder are then closed by piston 61 precisely to locate the contact pairs (FIG. 8D) and the transfer jaws 22 opened by engagement between finger 35 and pin 26 (FIG. 8E). The frame 47 is then moved upwardly by piston 49 and lever 48, to the position shown in broken lines in FIG. 6, to bring the contacts and tubular contact pin guides 50 into alignment with through-passageways 39 on opposite sides of a housing 41 (FIG. 8E). Contact pin guides are then advanced on the slide block 51 by piston 52 through the through-passageways 39 and over leading ends of contacts 36 (FIG. 8G). The contact gripping jaws 46 of the contact pin holder are raised by piston 61, the extended arm 54 holding clear wires of previously inserted contacts (FIG. 8H). The contact pin holder is then withdrawn by piston 62 and carriage 55 supporting contact pin pushers 43 and guides 50 is retracted by piston 56 to push contact pins 36 into respective through-cavities within guides 50 simultaneously withdrawing the guides from the front of the housing (FIG. 8I). The contact pushers 43 are then moved rearwardly and lowered and the contact pin holder further withdrawn by piston 62 (FIG. 8J) while the contact pin guides 50 are withdrawn by piston 52.

The housing 41 can be indexed to a new position by the mechanism 60 shown in FIG. 7 after lowering the frame 47 and return of the carrier 55.

We claim:

1. An apparatus for inserting a contact terminating a wire into a housing through-cavity comprising:

a. support means;

b. contact gripping jaws on the support means for gripping and locating the contact generally in alignment with the cavity and adjacent a rear face of the housing;

c. a reciprocable contact guide of complementary shape to the contact and mounted in alignment with the cavity adjacent a front face of the housing, and further having means to insert the guide through the cavity into mating engagement with the contact and to withdraw the guide from the cavity, d. a first contact pusher movably mounted on the support means for initial upward movement to receive a wire connected to a contact and subsequent horizontal movement along the wire to the contact to guide the contact precisely into alignment with the contact gripping jaws; and e. contact insertion means to insert the contact guided by the contact guide from the rear face into the cavity.

2. An apparatus according to claim 1 further including transfer means to transfer a contact to the contact gripping jaws.

3. An apparatus according to claim 2 wherein the transfer means is arranged to transfer a second contact terminating a second wire spaced apart in side-by-side relation to the first contact to the contact gripping jaws simultaneously with the first contact, and further includes a second contact pusher adjacent to the first contact pusher and movably mounted for movement with the first contact pusher, the contact pushers also being mounted for movement towards each other during movement along the wires to draw the contacts more closely together.

4. An apparatus according to claim 3 in which either contact pusher and the contact guide are linked for movement in the same direction to effect simultaneous contact insertion and contact guide withdrawal subsequent to release of the contact gripping jaws and release of the transfer means.

* * * * *